United States Patent [19]

Kopera

[11] 4,106,460

[45] Aug. 15, 1978

[54] HALL EFFECT ELECTRONIC IGNITION CONTROL UNIT WITH AUTOMATIC SHUT-DOWN TIMER

[75] Inventor: Joseph J. Kopera, Trenton, Mich.

[73] Assignee: Chrysler Corporation, Highland Park, Mich.

[21] Appl. No.: 743,021

[22] Filed: Nov. 18, 1976

[51] Int. Cl.[2] ..... F02P 9/00

[52] U.S. Cl. ..... 123/146.5 D; 123/148 S; 315/209 T

[58] Field of Search ..... 123/148 S, 146.5 D, 123/148 E, 146.5 A; 315/209 T

[56] References Cited

U.S. PATENT DOCUMENTS

| | | | |
|---|---|---|---|
| 3,262,438 | 7/1966 | Holford | 123/148 E |
| 3,745,985 | 7/1973 | Hohne | 123/146.5 D |
| 3,861,370 | 1/1975 | Howard | 123/148 E |
| 3,874,355 | 4/1975 | Suda et al. | 123/148 E |
| 3,884,208 | 5/1975 | Beuter | 123/148 E |
| 3,924,595 | 12/1975 | Brungsberg | 123/148 E |
| 3,940,658 | 2/1976 | Allred | 123/148 E |
| 3,949,722 | 4/1976 | Linstedt et al. | 123/148 E |
| 3,965,878 | 6/1976 | Salway | 123/148 E |
| 3,990,417 | 11/1976 | Tershak | 123/148 E |
| 4,008,698 | 2/1977 | Gartner | 123/148 E |

FOREIGN PATENT DOCUMENTS

| | | | |
|---|---|---|---|
| 2,332,442 | 1/1975 | Fed. Rep. of Germany | 123/148 S |

*Primary Examiner*—Charles J. Myhre
*Assistant Examiner*—Andrew M. Dolinar
*Attorney, Agent, or Firm*—Baldwin & Newtson

[57] ABSTRACT

An electronic ignition controller using a Hall Effect pickup Device for use in a ballast-resistorless, inductive-type ignition system for an automotive vehicle internal combustion engine and featuring an automatic shut-down timer, which operates to block the energization of the ignition coil if the controller remains in a state of conduction that maintains the ignition coil energized for a predetermined prolonged period of time that is greater than the dwell period or ON time of the coil at engine cranking speeds.

21 Claims, 2 Drawing Figures

HALL EFFECT ELECTRONIC IGNITION CONTROL UNIT WITH AUTOMATIC SHUT-DOWN TIMER

BACKGROUND OF THE INVENTION

This invention relates to electronic ignition controllers for internal combustion engines of automotive-type vehicles and, more particularly, to a low-cost, reliable electronic ignition controller which is triggerable from a velocity-insensitive Hall Effect pickup Device and is designed for use with a standard-type automotive ignition coil in a ballast-resistorless, inductive-type ignition system.

Prior forms of ignition controllers exhibiting some of the above characteristics are represented by U.S. Pat. Nos. 3,705,988; 3,861,370; 3,875,920 and 3,906,920, none of which, however, makes any provision for protection of the ignition coil from damage due to excessive current that could be drawn for a prolonged period as may occur during a stalled engine or delayed starting condition.

The invention seeks to avoid this deficiency in such inductive-type ignition systems which do not employ a ballast resistor and seeks in other ways to provide a simple, reliable and low cost electronic ignition controller.

SUMMARY OF INVENTION

Towards the accomplishment of the above and related objects, the invention provides a Hall Effect pickup controlled electronic ignition controller which features an automatic shutdown timer and senses whether the controller is in a state of conduction that permits the ignition coil to be energized from the vehicle electrical current source. The shut-down timer operates to change the conduction state of the controller and to block the energization of the ignition coil if the controller remains in the aforesaid state of conduction for a predetermined prolonged period of time, greater than the dwell period or ON time of the coil at engine cranking speeds. The internal design of the controller further includes protective circuits for the ignition coil connected to its output, for the Hall generator or pickup trigger device connected to its input and for the internal semiconductor components employed therein from the otherwise damaging effects of positive and negative going transients appearing on the electrical supply conductors, from the damaging effects of supply voltages that might be inadvertently applied to the input of the controller and from the damaging effects of high voltages induced in the coil and appearing at the output semiconductor switching device under unloaded coil conditions.

The above and other objects, features and advantages of the invention, together with the manner in which they are realized will appear more fully from consideration of the following detailed description made with reference to the accompanying drawings.

DESCRIPTION OF THE PREFERRED EMBODIMENT

Figure 1:
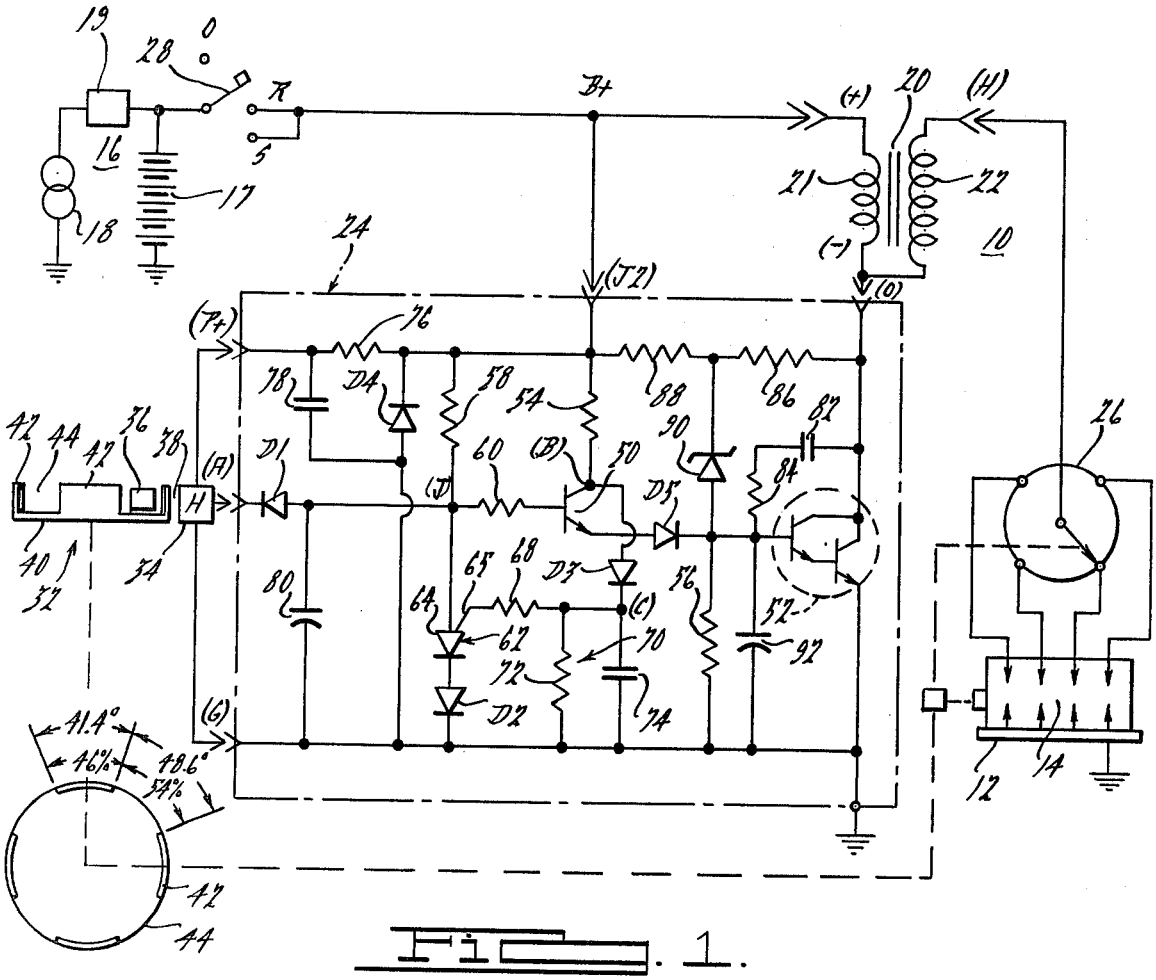
FIG. 1 is an electrical schematic circuit of the electronic ignition controller in accordance with the present invention.

Referring to the drawings, FIG. 1 illustrates in electrical schematic form an electronic ignition system 10 for a multicylinder, internal combustion engine 12 having a plurality of sparking-type firing devices 14 for igniting the fuel-air mixture conducted to the individual engine cylinders for combustably powering the engine. The ignition system is of the inductive storage-type in which energy from a low tension, electrical current source 16 is inductively stored in the field of an ignition coil 20 and in which a periodically operating mechanical or electronic control switch unit 24 interrupts the electrical energization of the primary winding 21 of the coil to collapse the field and induce high tension energy therein. The high tension energy is extracted from the secondary winding 22 of the ignition coil and is supplied from its high tension output terminal H and sequentially distributed to the individual spark plugs 14 of the engine through an engine driven distributor device 26.

The primary winding 21 of the ignition coil is connected at its plus (+) terminal through a manually-operable, control or ignition switch 28 to the elevated or plus potential side of the low tension D.C. electrical current source 16, which includes a negatively-grounded storage battery 17 charged from an alternator-rectifier 18 and associated voltage regulator 19. The negative terminal (−) of the ignition coil, common to the primary and secondary windings thereof, is connected to the negatively grounded side of the source 16 through the interrupter or control unit 24, which, in the apparatus of the present invention, is of the breakerless electronic switch variety triggered from a pickup device 32 operated in synchronism with the engine.

The pickup 32 is included in the ignition distributor 26 and is of the velocity insensitive variety, such as a Hall Effect generator or sensor Device, exhibiting a bi-stable switching conductivity or impedance characteristic when the sensor 34 is alternately exposed to and removed from the influence of a constant intensity radiation source such as a magnetic field from a permanent magnet 36. The magnet 36 is shown spaced from the field responsive Hall Device 34 by an air gap 38 in which is interposed a circular or cup-shaped trigger or shutter wheel 40 having formed thereon a plurality of equally and arcuately spaced, ferrous metal vanes 42 corresponding in number to the number of cylinders of the engine 12. The trigger or shutter wheel 40 functions as a field gating or switching element and is rotatably driven by the engine at one-half engine or crankshaft speed to successively interpose a metallic vane of field shunting portion 42 followed by a window or cut-out portion 44 between the stationary magnet 36 and Hall Device 34, which are located on opposite sides of the rotating shutter or trigger wheel 40 and are contained therewith within the housing of the distributor.

In the particular embodiment illustrated, the engine is of the four cylinder variety, whereby the shutter wheel will have four shunting elements or vanes 42, one of which is provided in each quadrant of the shutter wheel for each firing event in the engine. The shunting elements are spaced apart an arcuate distance between the trailing edge of one vane to the leading edge of an adjacent vane to provide a duty cycle of between 40 to 50%. A duty cycle of 46% has been found adequate for a four cylinder engine application to provide a dwell period of sufficient duration for charging of the ignition coil at high engine speeds up to 5,000 rpm, while controlling and limiting the power dissipation to acceptable levels at low engine speeds without the need for a ballast resistor for the controller.

With a 46% shutter for a four cylinder engine application, vane 42 will span an arcuate distance of 41.4° and each slot or window 44 an arcuate distance of 48.6°.

Figure 2:
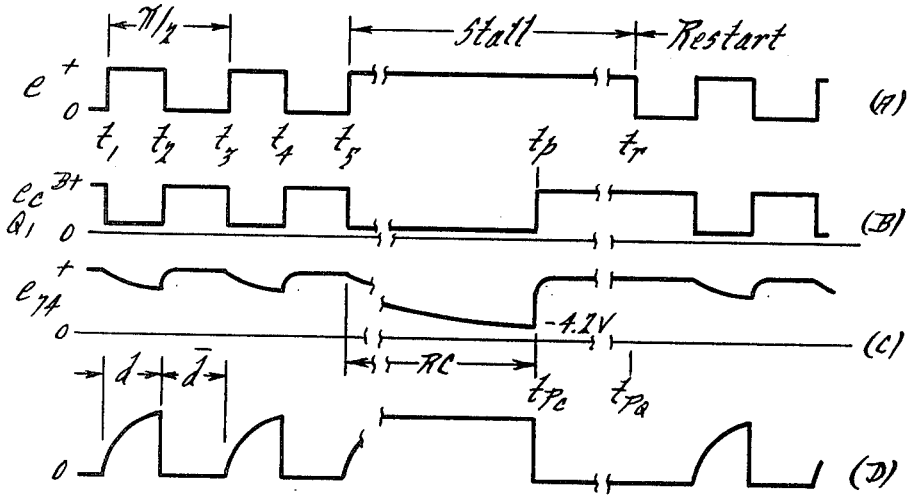
FIGS. 2A – D are wave forms of voltages appearing at correspondingly designated points in the circuit of FIG. 1 useful in understanding the operation of the invention.

The Hall Device has a high potential terminal and a low potential terminal labelled P+ and G, which are adapted to be connected to the high potential side and the low potential side respectively of a source of d.c. operating potential, and, when so connected, develops between a third or output terminal A and its reference or low potential terminal G, a constant amplitude, essentially rectangular electrical pulse signal. The output signal from or appearing at terminal A of the Hall Device is shown in FIG. 2A and has a pulse repetition rate which is related to the product of one-half the engine speed and the number of engine cylinders, and is of a fixed duty cycle or ratio of ON to ON plus OFF time in terms of distributor angle or percentage of time of the ignition cycle. When a vane 42 is interposed between the permanent magnet 36 and the Hall Device 34, the conductivity of the latter is low and the voltage at terminal A is high. The control unit 24 then conducts charging current through the ignition coil 20. Conversely, when the Hall Device is exposed to the magnet field, the conductivity of the sensor is high, the voltage level at terminal A is low and the ignition coil is not drawing current from the charging source.

The electronic control unit 24 is a five terminal case grounded structure, three of whose terminals, labelled P+, A, and G, are adapted to be connected to the corresponding terminals of the Hall Effect Device as shown, with a fourth terminal of the control unit adapted to be connected to the J2 terminal on the load side of the ignition switch 28. A fifth or output terminal, labelled (O), of the electronic control unit is adapted to be connected to the negative terminal (−) of the ignition coil 16, whose positive (=) terminal is shown connected to B+ through the run-start contacts R - S of the vehicle ignition switch 28. The ignition coil 16 is a standard coil of the conventional secondary to primary low turns ratio type 100:1 as customarily employed in the ignition systems of internal combustion engines for street or passenger car automotive vehicles.

Internally, the electronic control unit 24 comprises a driver stage, which includes an input switching NPN-type transistor 50, and a power switching output stage, which includes an NPN Darlington output transistor 52. The emitter electrode of the input transistor 50 is d.c. or direct current conductively connected to the base or input control electrode of the output transistor 52, whose collector electrode is connected to the output terminal (O) of the control unit and whose emitter electrode is connected to case ground. In distinction to conventional ignition systems, no ballast resistor is employed in the described ignition system. The output switching transistor 52 and ignition coil 20 are serially connected directly across the supply source 16 when transistor 52 is conducting, so that the full voltage of the source 16 is applied across the primary 21 of the ignition coil without any external current limitation device, except for the internal resistance of the coil itself.

Continuing with the description of the internal circuit configuration and structural content of the electronic ignition control unit 24, the input transistor 50 is adapted to be connected across the supply voltage source 16 in a circuit, which includes a resistor 54 of low ohmic value, say, 68 ohms for example, connected between the J2 terminal and the collector electrode of transistor 50 and the base emitter path of the output switching transistor 52 having a leakage resistor 56 of, say 390 ohms, connected between its base electrode and case ground. Base current drive is supplied to transistor 50 through a voltage divider comprised of resistors 58 and 60, which are connected in series between the J2 terminal and the base electrode of transistor 50. Resistors 58 and 60 may have resistance values of, say, 750 ohms and 220 ohms for example, respectively. The junction J of the divider resistors 58, and 60 is connected to the input terminal A of the electronic control unit that is adapted to be connected to the corresponding output terminal of the Hall Device. Another circuit extends from the junction of the resistors 58 and 60 through the output electrodes of a voltage-operated, conduction latching device 62, which is characterized by a high input impedance and is connected through a compensation diode D2 to case ground.

Conduction latching device 62 is a semiconductor switching device, which, together with an RC discharge timing circuit 70 comprised of a resistor 72 and a capacitor 74, forms the shutdown timer switch circuit of the present invention. Preferably, the voltage conduction latching device 62 is a programmable unijunction transistor, whose control or gate electrode 65 is connected through a resistor 68 to the ungrounded side of the junction of the RC discharge circuit 70 and the cathode of an isolation diode D3 whose anode is connected to the collector electrode of transistor 60.

The remainder of the circuit is constituted by circuit protection devices including a diode D4, which is shown connected between the J2 terminal and case ground and provides circuit protection for negative or reverse transients appearing on the supply conductors.

Protection to the Hall Device from the otherwise damaging effects of positive-going voltage transients appearing on the B+ supply line is provided by an attentuation filter comprised of a resistor 76, which is internally connected between the J2 terminal and the P+ terminal of the electronic control unit, and a capacitor 78, which is connected across the P+ terminal and case ground. A capacitor 80, which is connected between the anode of Diode D1 and case ground, provides RF suppression to protect the base of the input transistor 50.

Diode D1 is a silicon diode which protects the input of transistor 50 from the otherwise damaging effect of B+ battery or supply voltage inadvertently applied to the input terminal A of the control unit, while diode D2 provides compensation for the effect of the diode drop caused by the insertion of the protection diode D1 in the input circuit to transistor 50.

Diode D5 connected between the emitter electrode of transistor 50 and the base input electrode of transistor 52 provides an additional voltage drop or bias to prevent the output transistor 52 from partially turning on when the automatic shutdown timer circuit is operating and holding the transistors 50 and 52 non-conducting. The addition of diode D2 may cause the voltage at the input of transistor 50 to turn it on slightly when PUT 62 is conducting and tend to turn transistor 52 back on, which tendency is avoided by the use of the diode D5.

The power output switching stage, comprising the Darlington output transistor 52, is also provided with several circuit protection networks including a transient feedback circuit comprised of a capacitor 82 and a resistor 84, which are serially connected between the collector output and the base input electrode of transistor 52. This circuit suppresses the leakage reactance effect of the ignition coil and eliminates the need for the large capacitor, which would otherwise be connected across the output electrodes of the output transistor or breaker points as customarily employed in prior forms of ignition systems. Divider resistors 86 and 88, which are connected between the collector electrodes of the output and driver transistors 52 and 50, together with a Zener diode 90, which is connected as shown between the divider junction and the base of transistor 52, protect the output transistor 52 from the damaging effects of the high induced voltages that may appear under no load coil conditions at the collector of the output transistor when the output transistor is non-conducting. Should the voltage at the collector of transistor 52 rise above the voltage rating of Zener diode 90 when transistor 52 is OFF, the Zener breaks down to conduct current into the base of transistor 52 to turn it on and limit the rise of the voltage at its collector.

In accordance with one aspect of the invention, the programmable unijunction transistor 62 an the RC timing circuit 70, formed by capacitor C74 and R72, comprise an RC time delay switching means which functions to shut down the electronic control unit 24 and prevent continuous or prolonged energization of the ignition coil as may sometimes occur during an engine stall condition, for example.

Under such a condition, the transistors 50 and 52 can be left in a conducting state when the trigger wheel of the velocity insensitive pickup device 32 should be stopped in a position with a shutter vane 42 located in the air gap between the magnet 36 and Hall sensor 34. In view of the absence of a ballast resistor in the ignition system with which the subject electronic control unit is employed, the ignition coil will be continuously energized and can draw an excessive amount of current, which, over a prolonged period, will overheat the coil with subsequent damage thereto.

The described coil shut-down timer circuit senses this condition when the ignition switch 20 is closed by sensing the conducting state of the input transistor 50. In the event transistor 50 should remain in the aforesaid conducting state for a predetermined period determined by the RC discharge time constant of the timer, the timer circuit operates to change the state of conduction of transistor 50 and thus render output transistor 52 non-conductive to terminate the flow of current through the ignition coil.

The operation of the electronic control unit and the shut-down timer circuit therein will be evident from the wave forms of FIGS. 2A–D in which FIG. 2A represents the voltage levels at point A when the electronic control unit 24 is energized from the source 16 through the ignition switch 28 and is connected to the Hall Effect sensor 34.

With the engine running and driving the trigger or shutter wheel 40, assume that at time $t_1$ a shutter vane 42 is positioned in the air gap 38 to shunt the field of the permanent magnet 36 from the Hall sensor element 36. The electrical conductivity of the latter will then be low, and the voltage level at point A will be high. Transistor 50 will receive base current drive through resistors 58 and 60 to render it conductive and to supply base current drive for the Darlington Output transistor 52, which will also be in a conducting state. Energizing current will start to flow in the primary winding of the ignition coil, commencing the dwell period *d* of the ignition cycle during which period the ignition coil is being energized or charged from the source 16 as shown in FIG. 2D.

At time $t_2$ the trigger or shutter wheel 40 has rotated a distance such that the window or cut-out portion 44 therein is interposed between the magnet 36 and Hall sensor 34. The conductivity of the Hall sensor will then be high and the voltage level at terminal A of the control unit is low. Diode D1 conducts and diverts or deprives base current from transistor 50 to turn it off, raising the voltage at its collector to B+ as shown in FIG. 2B. Output transistor 52 will then be deprived of base current and rendered non-conductive to interrupt the energization of the ignition coil from the source and commence the anti-dwell portion, *d*, of the ignition cycle. During this time or period, high tension energy, which is induced in the secondary winding of the ignition coil by the collapse of the field in the coil, is supplied to a particular spark plug selected by the distributor for firing the engine.

With the input transistor 50 shut off, the voltage at its collector electrode rises to the level of the B+ supply voltage, and timing capacitor C74, which has a capacity of 1.5 microfarads, is connected in a charging circuit with the 68 ohm R54 to be rapidly charged as shown in FIG. 2C from B+ through R54 and forward biased diode D3.

At time $t_3$, the trigger wheel 40 has been rotated $\pi/2$ radians or 90 mechanical or distributor degrees in space from its position at time $t_1$ to position the next adjacent shutter vane in the direction of the rotation of the trigger wheel in the air gap 38 of the Hall Device. The Hall sensor element 34 thus decreases its conductivity and allows the voltage at terminal A to rise, which turns on transistor 50 and, hence, the Darlington output transistor 52. With both transistors conducting, the voltage at the collector electrode of the input transistor 50 falls to a level approximately three diode drops plus 0.3 volts above ground and back-biases isolation diode D3. Previously charged timing capacitor C74 then commences to discharge through R72, which has a resistance of 1 megohm, and applies a potential at the gate 65 of the PUT 62 that follows the discharge curve of the discharge circuit as shown in FIG. 2C.

The anode 64 of the PUT device 62 is connected to the divider junction J of resistors 58, and 60, which is at a level of around +4.8 volts when transistor 50 is conducting and prevents the PUT from latching into conduction until such time as the control voltage at its gate electrode 65 decays or falls a diode voltage drop, say 0.6 v., below the programmed +4.8 volt operating level. However, the RC time constant of the discharge timing circuit R72 and C74 is selected to be of prolonged duration relative to and is several orders of magnitude greater than the dwell period of the ignition cycle at low engine speeds, say, around 50 rpm or at cranking, so that the timing circuit will not have timed out unless the engine has stopped, as when it goes into a stalled condition.

Thus, at time $t_4$, so long as the engine is still moving and the trigger wheel is rotating, the next cut-out portion 44 of the trigger wheel 40 following the shutter vane is now positioned in the air gap 38 of the Hall Device to increase its conductivity and drop the voltage level at trigger signal input terminal A to slightly above ground level. Input transistor 50 turns off and C74 starts to charge from some level above 5 volts back towards B+ through charging resistor 54, which is of a low ohmic value relative to the one megohm discharge circuit resistor R72. Thus, so long as the engine is rotating, the timing circuit does not have an opportunity to time out and operate the PUT and is automatically reset by the change in the conduction state of transistor 50 caused by the engine rotation of the trigger wheel.

Assume now that the engine has gone into a stall condition and stopped, as indicated at time $t_s$, with a vane of the trigger wheel positioned in the air gap of the Hall Effect Device. The voltage level at terminal A then will be high, rendering transistor 50 conductive to drop the voltage level at its collector electrode. Diode D3 becomes back biased and permits timing capacitor 74 to discharge from its previously charged B+ level through discharge resistor 72. Inasmuch as the engine is in a stall condition and the shutter wheel is not rotating, the conduction state of transistor 50 will not be changed and the discharge timing circuit will have a prolonged discharge until such time as the voltage at the gate of the PUT device 62 decays to a level one diode voltage drop below the programmed operating voltage level at its anode. At this time, $t_p$, the PUT turns on and latches into conduction to divert base current from transistor 50 and turn it off, which action turns off output transistor 52 and results in the deenergization of the ignition coil 20 from the voltage source 16.

The ignition system remains in this condition with the PUT 62 latched into conduction and the ignition switch 28 closed until the engine is subsequently cranked or restarted as shown at time $t_r$ when the shutter wheel 40 is once again rotated and moves a shutter vane 42 thereof into the air gap of the Hall Effect Device to increase the voltage level at point A and permit the input transistor 50 to turn on once again. PUT 62 is then quenched by the action of the Hall Device.

What is claimed is:

1. A triggerable electronic control unit apparatus for controlling the energization of the ignition coil of an inductive-type ignition system from a source of low tension energy to apply high tension energy to a sparking device of an internal combustion engine upon triggering of said control unit from a trigger device driven in synchronism with the engine; said control unit comprising a controllable semiconductor power switching device adapted to be connected in series with the ignition coil directly across said source when the power switching device is conductive; a control transistor having collector, base and emitter electrodes coupled in conductivity controlling relation with said power switching device and triggerable between a conducting and a non-conducting state by said trigger device; and time delay control switch means connected to the control transistor and operative to change the state of conduction thereof and render said power switching device non-conductive when the control transistor remains in a state of conduction which renders the power switching device conductive for a period of time greater than the dwell period of the ignition cycle at engine cranking speeds, said time delay control switch means including a timing capacitor coupled to the collector electrode of said control transistor to be rapidly charged from said source when the control transistor is non-conductive, a discharge resistor connected in parallel with said timing capacitor to be slowly discharged when said control transistor is rendered conductive, and a third controllable semiconductor switching device having a pair of output electrodes connected in a circuit across the input circuit of said control transistor and a control electrode coupled to the timing capacitor, whereby said time delay switch means renders said control transistor non-conductive to shut off the power switching device and stop current flow through the ignition coil if the control transistor and power switching device remain on for a period of time greater than the dwell period of the ignition cycle at engine cranking speeds.

2. Apparatus in accordance with claim 1 wherein an isolation diode is connected between the collector electrode of said control transistor and the timing capacitor and is back-biased to permit the timing capacitor to discharge through the discharge resistor when the control transistor is conductive.

3. Apparatus in accordance with claim 2 whereIn said third controllable semiconductor switching device is a voltage conduction latching device.

4. Apparatus in accordance with claim 3 wherein said voltage conduction latching device is a programmable unijunction transistor.

5. Apparatus in accordance with claim 4 including a voltage divider, which is connected between the base electrode of the control transistor and a terminal of the electronic control unit adapted to be connected to the high potential side of said source, and wherein the programmable unijunction transistor device has its anode electrode connected to the junction of the voltage divider and its gate control electrode connected to the junction of the timing capacitor and the isolation diode.

6. Apparatus in accordance with claim 5 wherein the programmable unijunction transistor is quenched by the application of a low level triggering signal from the pickup device to the control unit upon cranking and engine rotation.

7. Apparatus in accordance with claim 6 including a second diode connected between the junction of the divider and a terminal of the control unit adapted to be connected to receive the triggering signal from said trigger device.

8. Apparatus in accordance with claim 7 including a third diode connected between the programmable unijunction transistor device and a terminal of the control unit adapted to be connected to the low potential side of said source.

9. Apparatus in accordance with claim 8 including a fourth diode connected between the control transistor and the controllable semiconductor power switching device.

10. Apparatus in accordance with claim 1 above wherein said electronic control unit is triggered from a velocity insensitive pick-up, such as a Hall sensor, device.

11. Apparatus in accordance with claim 10 above wherein said electronic control unit is triggered on and off directly in accordance with the triggering signal from the Hall sensor device and exhibits a constant dwell angle characteristic and a duty cycle of between 40 and 50% of the ignition cycle for a four cylinder internal combustion engine.

12. Apparatus in accordance with claim 10 wherein said Hall sensor device has a pair of terminals to receive operating voltage supplied from said low tension source of energy and wherein said electronic control unit includes an attentuation filter through which operating voltage is supplied from said source to said operating terminals of said Hall sensor device and which protects the latter from the otherwise damaging effects of voltage transients appearing on the supply lines.

13. Apparatus in accordance with claim 10 wherein said electronic control unit has a trigger input signal terminal adapted to be connected to receive a trigger signal from said Hall sensor device and includes a diode connected in a circuit between said trigger input terminal and said control transistor.

14. Apparatus in accordance with claim 1 above wherein said controllable semiconductor power switching device is connected in series with the ignition coil directly across said source to receive the full voltage of the source across the coil and said controllable semiconductor power switching device without any external current limiting device except for the internal resistance of the ignition coil when said controllable semiconductor power switching device is conductive.

15. A ballast eliminating electronic control unit for an internal combustion engine ignition system having an ignition coil whose primary winding is connected at one side to one side of a source of low tension energy for the dwell period of the ignition cycle and is electronically decoupled from said source for the remainder or the anti-dwell period of the ignition cycle to supply high tension energy from the secondary winding of the ignition coil to an engine sparking device upon the triggering of the control unit from an engine driven triggering device; said electronic control unit comprising a first controllable semiconductor power switching device having a pair of output terminals respectively connectable to the other side of the ignition coil primary winding and the other side of said energy source; a second controllable semiconductor switching device coupled in conductivity controlling relation with said first controllable semiconductor power switching device and having an input control terminal for reception of conductivity affecting triggering signals from said engine driven triggering device; and time delay controlled switch means connected to said second controllable semiconductor switching device and including a timing capacitor, which is connected with a first resistor in a capacitor charging circuit rapidly chargeable from said energy source during the anti-dwell period of the ignition cycle and is connected with a second resistor in a relatively slower capacitor discharging circuit during the dwell period of the ignition cycle, said time delay controlled switch means operative by said capacitor discharging circuit to change the state of conduction of said second controllable semiconductor switching device and abruptly turn off said first controllable semiconductor power switching device, if the ignition coil remains energized for a period of time, which is greater than the dwell period of the ignition cycle at engine cranking speeds and is in the order of a time constant of said capacitor discharge circuit.

16. An electronic control unit for controlling the energization and de-energization of the primary winding of the ignition coil of an internal combustion engine ignition system from a source of low tension energy connected at one side to one side of said primary winding of said coil for supplying high tension electrical energy from the secondary winding of the coil to an engine sparking device upon operation of said control unit from an engine driven pick-up device developing a triggering signal for each ignition cycle of the engine; said electronic control unit having a pair of supply terminals for connection to said source, a pair of input terminals for connection to said pick-up device with one of said input terminals connected to one of said supply terminals, and an output terminal for connection to the other side of said ignition coil primary winding;

a first and a second transistor device each having base, collector and emitter electrodes of which the collector and emitter electrodes are output electrodes and the output electrodes of the first transistor are connected between the said one of said supply terminals and said output terminal and its base electrode is coupled to one of the output electrodes of the second transistor whose base electrode is coupled to the other one of the input terminals; and a time delay switch means including a timing capacitor connected in a circuit between the other one of the output electrodes of the second transistor and the said one of the supply terminals, a first resistor connected between the said other one of the output electrodes of the second transistor and the other supply terminal, a second resistor connected across the timing capacitor, and a controllable semiconductor switch means having a pair of output electrodes connected in a circuit between the said input terminals of said electronic control unit and a control electrode connected to the timing capacitor.

17. An electronic control unit in accordance with claim 16 above wherein said capacitor and first resistor have a time constant less than the dwell period of the ignition cycle of said ignition system at high engine operating speeds and said capacitor and second resistor have a time constant greater than the dwell period of the ignition cycle at engine cranking speeds.

18. An electronic control unit in accordance with claim 16 above wherein said controllable semiconductor switch means is a voltage conduction latching device having a high input impedance.

19. An electronic control unit in accordance with claim 18 above where in said controllable semiconductor switch means is a programmable unijunction transistor.

20. An electronic control unit in accordance with claim 16 including a voltage divider connected in a circuit between the said other one of said supply terminals and the said base electrode of said second transistor and wherein one of said output electrodes of said switch means is connected to the junction of said voltage divider.

21. An electronic control unit in accordance with claim 20 for use with a Hall Effect pickup device having a pair of excitation terminals and at least one output terminal and wherein said electronic control unit has an additional terminal for connection to one of the excitation terminals of the Hall Effect pickup device and has an attenuation filter including a resistor connected between the other one of its supply terminals and its said additional terminal and a capacitor connected between the latter terminal and the said one of its supply terminals.

* * * * *